US009048604B2

(12) United States Patent
Schall et al.

(10) Patent No.: US 9,048,604 B2
(45) Date of Patent: Jun. 2, 2015

(54) METHOD AND ADJUSTMENT DEVICE FOR ORIENTATING CONTACT PINS OF AN ELECTRIC COMPONENT AND ELECTRIC COMPONENT

(75) Inventors: Michael Schall, Heppenheim/Sonderbach (DE); Dirk Duenkel, Bensheim (DE); Gregor Panitz, Soergenloch (DE); Zan Polsak, Fuerth (DE); Sarah Thomas, Laudenbach (DE)

(73) Assignee: Tyco Electronics AMP GmbH, Bernsheim (DE)

( * ) Notice: Subject to any disclaimer, the term of this patent is extended or adjusted under 35 U.S.C. 154(b) by 155 days.

(21) Appl. No.: 13/825,549

(22) PCT Filed: Sep. 20, 2011

(86) PCT No.: PCT/EP2011/066259
§ 371 (c)(1),
(2), (4) Date: Mar. 21, 2013

(87) PCT Pub. No.: WO2012/038388
PCT Pub. Date: Mar. 29, 2012

(65) Prior Publication Data

US 2013/0178113 A1 Jul. 11, 2013

(30) Foreign Application Priority Data

Sep. 22, 2010 (DE) ..... 10 2010 046 050

(51) Int. Cl.

| | |
|---|---|
| ***H01R 24/00*** | (2011.01) |
| ***H01R 43/00*** | (2006.01) |
| ***H01R 12/71*** | (2011.01) |
| ***H01R 43/16*** | (2006.01) |
| ***H01R 13/02*** | (2006.01) |

(52) U.S. Cl.
CPC ..... *H01R 43/00* (2013.01); *Y10T 29/49208* (2013.01); *H01R 12/712* (2013.01); *H01R 43/16* (2013.01); *H01R 13/02* (2013.01)

(58) Field of Classification Search
CPC ..... H01R 43/00; H01R 13/02; H01R 12/712; H01R 43/16; Y10T 29/49208
USPC ..... 439/660; 29/876
See application file for complete search history.

(56) References Cited

U.S. PATENT DOCUMENTS

| | | | | |
|---|---|---|---|---|
| 5,129,832 | A | 7/1992 | Marsh et al. | |
| 2008/0223503 | A1 | 9/2008 | Ju | |
| 2010/0144171 | A1 * | 6/2010 | Lechner et al. | 439/78 |

FOREIGN PATENT DOCUMENTS

| | | |
|---|---|---|
| EP | 1081811 | 3/2001 |
| WO | WO2010032092 | 3/2010 |

OTHER PUBLICATIONS

International Search Report and Written Opinion issued by the European Patent Office, dated Nov. 15, 2011, for related International Application No. PCT/EP2011/066259; 14 pages.
International Preliminary Report on Patentability issued by the International Bureau of WIPO, Geneva, Switzerland, dated Mar. 26, 2013, for related International Application No. PCT/EP2011/066259; 9 pages.

* cited by examiner

*Primary Examiner* — Javaid Nasri
(74) *Attorney, Agent, or Firm* — Faegre Bakeer Daniels LLP

(57) ABSTRACT

The invention relates to a method (9) and an adjustment arrangement (2) for orientating contact pins (4) of an electric component (1) and to an electric component (1) having a plurality of contact pins (4). So as to be able to orientate the contact pins (4) as precisely and efficiently as possible along a contact contour (K) at least in portions and thus be able to fit the electric component (1) securely on a contact carrier, the invention provides that a plurality of contact pins (4) arranged along the contact contour (K) in advance are orientated simultaneously by a shaping body (3) to form the contact contour (K), the shaping body (3) being part of the adjustment arrangement (2).

17 Claims, 4 Drawing Sheets

METHOD AND ADJUSTMENT DEVICE FOR ORIENTATING CONTACT PINS OF AN ELECTRIC COMPONENT AND ELECTRIC COMPONENT

BACKGROUND

The invention relates to a method for orientating contact pins of an electric component in which a plurality of contact pins are preformed and arranged along a contact contour. The invention further relates to an adjustment arrangement for orientating preformed contact pins of an electric component which are arranged to form a contact contour, comprising a holding device for fixing the component. The invention further relates to an electric component comprising a plurality of contact pins.

Methods and adjustment devices for orientating contact pins of an electric component are known and are widely used in the production of electric components. In this context, the electric component may for example be a plug connector, a microchip, a capacitor or another component which comprises at least two contact pins and can be connected to a contact carrier and soldered, for example via the contact pins thereof, to the contact surfaces thereof.

The contact pins are for example mounted on a housing body of an electric component, the contact pins being preformed from an elongate shape into a bent contact shape before or after mounting. When mounted and preformed, the contact pins are arranged approximately along a contact contour, at least in portions. In many cases, the contact pins are to be arranged mutually flush along the contact contour. However, tolerances when mounting and preforming the contact pins mean that the contact pins are not arranged precisely along the contact contour. Rather, the contact pins deviate from the target position thereof in relation to the contact contour, for example by ±0.3 mm or more. A deviation of this type may result in insufficiently contacted contact pins in a fitting process in which the electric component is for example to be mounted on the contact carrier.

The object of the invention is therefore to provide a method and an adjustment arrangement for orientating preformed contact pins of an electric component, with which the contact pins can be orientated more precisely than before along the contact contour, and an electric component which can be fitted securely.

SUMMARY

This object is achieved for the method mentioned at the outset in that the orientated contact pins are subsequently, i.e. after being arranged, orientated simultaneously by a shaping body to form the contact contour. For the adjustment arrangement mentioned at the outset, this object is achieved by a shaping body with which a plurality of contact pins can be orientated simultaneously to form the contact contour. For the electric component mentioned at the outset, this object is achieved in that at least some of the contact pins are orientated using the method according to the invention or with an adjustment arrangement to form the contact contour according to the invention, or in that the contact pins are arranged with a deviation of at most ±0.15 mm from a predetermined contact contour.

Subsequently orientating the preformed and mounted contact pins means that they are orientated precisely and efficiently to form the contact contour not only during the production process of the component. Subsequent fine orientation of the contact pins is also possible, in such a way that for example contact pins of the electric component can be orientated shortly before it is fitted on the contact carrier. Moreover, simultaneous fine orientation of a plurality of contact pins makes rapid, efficient orientation of a plurality, and potentially all, of the contact pins of the electric component possible. In this context, the contact pins may be orientated to form the common contact contour independently of the arrangement thereof on the electric component. The contact pins may be positioned so precisely that they deviate at most by ±0.15 mm or less from the target position thereof along the contact contour. This is sufficient for providing secure soldering of the electric component to soldering contacts of the contact carrier.

The solution according to the invention can be further improved by means of various configurations which are each advantageous per se and can be combined with one another as desired. These embodiments and the advantages associated therewith are discussed in the following, the constructional measures and the effects thereof being described merely by way of example.

In a first advantageous embodiment of the method, contact pins arranged on a contact side of the component are orientated simultaneously. As a result, at least two of the contact pins arranged on the side of the component, and in particular all of the contact pins on this side, are orientated simultaneously and thus rapidly and efficiently along the contact contour. No tedious orientation of individual contact pins is required. If the component is to have a plurality of sides provided with contact pins, the contact pins of a plurality of sides may also be orientated simultaneously. It is also possible for only selected contact pins or all of the contact pins to be orientated along the contact contour simultaneously.

Different portions of the contact pins can be orientated along the contact contour. For example, the contact pins may comprise a fixing portion, a spacer portion and a contact portion. The contact pins can be fixed to the housing body of the electrical component via the fixing portion. In many cases, the fixing portion extends parallel to the housing body and extends to a contact support on which the component is to be fitted. The spacer portion may be attached to the end of the fixing portion facing away from the housing body, and often extends at an angle, and in particular at an angle of 90°, to the fixing portion. When the contact pins are mounted on the housing body, the spacer portions of different contact pins may face in a common direction.

On the end of the spacer portion facing away from the fixing portion, the contact pins may have a contact portion. The contact portion may for example be arranged flush with the spacer portion and be inserted into a contact socket of the contact support. Alternatively, the contact portion may also be orientated extending at an angle to the spacer portion and be orientated towards or away from the electric component. The electric components may have what are known as J-lead or gull-wing contact pins, which are formed substantially C-shaped or Z-shaped. As what are known as surface-mounted components (SMD's), components equipped with contact pins of this type can be fitted and soldered particularly easily.

One or more of the above-mentioned portions may be orientated along the contact contour in each case. The contact contour is thus defined by the optimally orientated portions of the contact pins.

In a particularly advantageous embodiment, in particular the contact portions arranged at the free ends of the contact pins can be orientated along the contact contour. Contact portions which are orientated as precisely as possible along the contact contour make the electric components easy to fit, since the well-defined position of the contact portions provides contact against counter contacts of the contact carrier. As a result, the contact pins can be soldered securely to the counter contacts.

In practice, the approximately arranged contact pins which are to be orientated may deviate to varying extents from the target position thereof along the contact contour. Orientating the contact pins by means of the shaping body may result in those portions of the contact pins which are to be orientated being deflected by the shaping body by different amounts. Since contact pins are generally formed of metal and thus have resilient properties, it is also possible for some contact pins to be deformed plastically while others still remain in the resilient deformation region thereof. If the shaping body is removed again, this may result in the contact pins having different resilient return paths and in the contact pins which are to be finely orientated still being orientated differently along the contact contour. To solve this problem, all of the contact pins may be bent until the contact pins which are to be orientated are all deformed plastically rather than resiliently. The contact pins may also be deflected beyond the target position thereof, in which case they subsequently all return to the target positions thereof substantially evenly based on the resilient return paths thereof. Further, the contact pins may be deflected beyond the target position thereof and subsequently all be bent back substantially evenly into the target position thereof.

To prevent slippage at least of the contact portions from the target position thereof and relative to the housing body, the contact pins may be held for orientation along the contact contour, and at the same time, the component, and in particular the housing body thereof, may be thermally treated. For example, the contact pins may be held by the shaping body and the housing body may be heated. The thermal treatment may cause the housing body to become plastically deformable at least in part and to wrap around the contact pins. This results in a permanent positive connection between the housing body and the contact pins.

So as to be able to orientate the contact pins, the holding device and the shaping body may be movable towards one another. The shaping body may be movable in a manner guided towards the holding device, it being possible for the movement to end in a predefined orientation position. For this purpose, the adjustment arrangement may have guide elements and stop members, which make possible a defined movement of the shaping body in a manner defined relative to the holding device. The adjustment arrangement may also have location or force sensors, by means of which the relative movement of the shaping body can be monitored and for example power-controlled. As a result, even the contact pins of different components can repeatedly be orientated not only simultaneously with one another, but moreover also in a defined manner along the contact contour.

The shaping body may have an orientation face which is formed corresponding to the contact contour at least in portions. The contact pins can thus be orientated simply by being pressed against the orientation face. The orientation face may have a profile course which reproduces the contact contour, and said course may for example be formed with oscillations or steps. However, it is particularly advantageous, since it is often required in practice, for the orientation face to have a planar profile course, which makes it possible to fix the component securely to a generally planar circuit board.

So as to be able to guide and/or hold the contact pins during orientation, the shaping body may be formed complementary to the contact pins, and in particular to the contact ends thereof, at least in portions. For example, the shaping body may be formed with a holding structure in the form of grooves, cavities or blind holes, which each receive one of the contact ends at least in portions and can secure it against unintended slippage parallel to the contact contour.

Further, in a further embodiment the adjustment arrangement may have a heating device with which the component can be heated. The heating device may for example be configured as a radiant heater or a heater fan. With heating devices of this type, a side of the housing body of the component can be warmed in a simple manner during the orientation process, without additional heating elements having to be brought into a direct connection with the housing body.

Alternatively, the heating device may have a heating element which can be brought into mechanical contact with the housing body. For example, the heating device may have a heatable hot stamp, and the contact pins may be held in the target position thereof along the contact contour between the hot stamp and the shaping body, and be arranged and potentially clamped between the heating element and the shaping body. The hot stamp may also selectively heat the housing body while lying against it and thus be arranged at a distance from the contact ends.

Further, it is possible to provide a contact control unit with which the mechanical contact between the shaping body and the respective contact pins to be orientated can be controlled. For example, the contact control unit may cause an electric current to flow between at least individual contact pins which are to be orientated and the shaping body when these are in mutual mechanical contact. If the contact control unit does not detect any flow of current between at least one of the contact pins to be orientated and the shaping body, it can output an error signal.

To check the contact between the shaping body and individual or selected contact pins, the shaping body may have at least one shaping segment which can be electrically contacted separately from the remainder of the shaping body. The at least one shaping segment may lie against the contact pin during the orientation thereof and have the holding structure which is formed complementary to the contact pin at least in part and be connected permanently or replaceably to a shell of the contact body. For example, the shaping segment may be configured with at least one shaping cavity which is formed substantially complementary to one of the contact pins.

The invention is explained by way of example in the following by means of embodiments, with reference to the drawings. The different features of the embodiments may be combined independently of one another, as was stated previously for the individual advantageous configurations.

DETAILED DESCRIPTION

First, the construction and operation of an adjustment arrangement according to the invention will be described with reference to the embodiment of FIG. 1.

Figure 1:
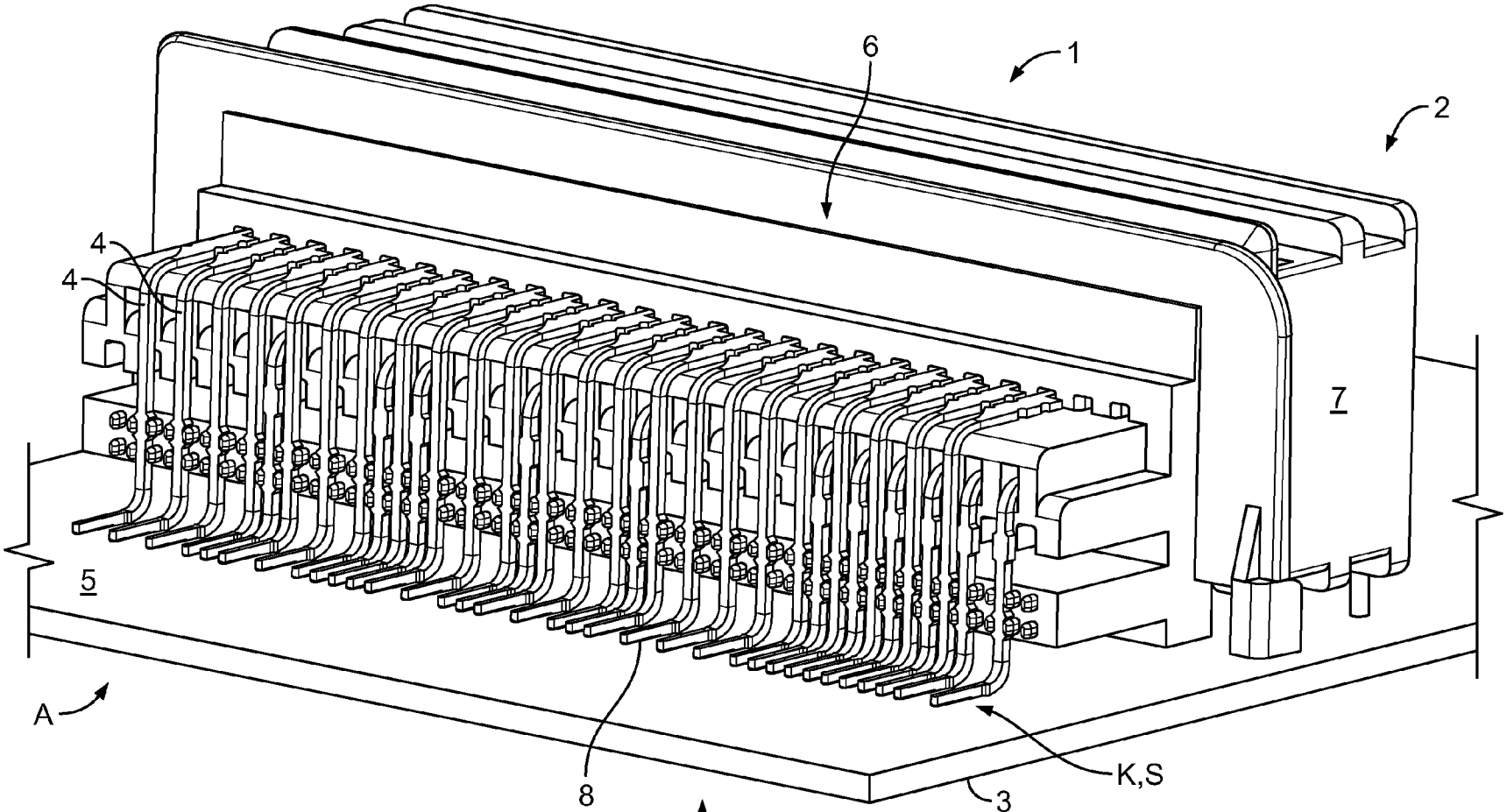
FIG. 1 shows an electric component having a plurality of preformed contact pins arranged along a contact contour in an adjustment arrangement.

FIG. 1 is a schematic, perspective view of an electric component 1, which is a plug connector in the embodiment shown, the electric component 1 being arranged in an adjustment arrangement 2 for orientating contact pins. Of the adjustment arrangement 2, FIG. 1 merely shows a shaping body 3, which in this case is shown schematically as a plate.

The electric component 1 can be fixed in a holding device 30 in such a way that at least two of the contact pins 4 thereof are accessible by the shaping body 3. The shaping body 3 is shown in the orientation position A thereof in which a plurality of contact pins 4 can lie at least in portions against an orientation face 5 of the shaping body 3. In the orientation position A, the shaping body 3 can press a plurality of contact pins 4 in a pressing direction R into the target position S thereof along a contact contour K. In this context, the contact pins 4 can resiliently be pressed beyond the target position S thereof, at least in part, and return into the target position S when the shaping body 3 is removed from the orientation position A thereof. For example, the shaped body 3 may be moved away from the electric component 1 counter to the pressing direction R.

In the embodiment of FIG. 1, the electric component 1 only has contact pins 4 on one side 6. Alternatively, the electric component 1 may also have contact pins 4 on other or on a plurality of sides 6. For example, the contact pins 4 may be arranged on sides 6 which are mutually opposing or which encircle the component 1. The contact pins 4 may also be provided on an underside arranged between two sides 6 of the component 1.

The contact pins 4 may be permanently connected to a housing body 7 of the electric component 1 and be preformed in such a way that they are arranged approximately along the contact contour K, at least in portions. The contact pins 4 may be fixed on the housing body 7 in different positions. In the embodiment shown here, a plurality of contact pins are arranged in two parallel rows on the side 6 of the housing body 7 in such a way that the contact portions 8 thereof are arranged approximately along the contact contour K.

In this embodiment, the contact portions 8 arranged at free ends of the contact pins 4 are orientated to form the contact contour K, which in this case is configured as a plane. The contact pins 4 are formed as what are known as SMD contacts, which can be fixed to contact surfaces of a contact carrier, for example to planar solder contacts of a circuit board. The orientation face 5 may therefore be formed with a planar profile course. The profile course of the orientation face 5 of the shaping body 3 substantially corresponds to the contact contour K along which the target positions S of at least portions of the contact pins 4 are located. In the embodiment shown in this case, the profile course of the orientation face corresponds to a plane, but it may also extend in some other manner and for example have oscillations or steps.

So as to be able to orientate the contact pins 4, and in particular the contact portions 8 thereof, along the contact contour K even when they are lying against the shaping body 3 in the target position S thereof while insufficiently plastically deformed or even exclusively resiliently deformed, the contact pins 4 may also be overpressed in a defined manner for fine orientation. When the shaping body 3 is removed from the contact pins 4 again, the portions thereof which are to be orientated may return resiliently into the target position S or be pressed back plastically into said position.

The shaping body 3 may be formed complementary to the contact pins 4, and in particular to the contact ends 8 thereof, at least in portions. For example, the shaping body 3 may have a holding structure with grooves, cavities or blind holes, on each of which one of the contact ends 8 can be arranged and potentially held at least in part during the orientation process.

Further, the shaping body 3 may comprise at least one separate shaping segment 32, for at least one of the contact pins 4, against which the contact pin 4 can lie during the orientation process. The shaping segment 32 may be formed with the holding structure, i.e. the groove, the cavity or the blind hole, which is complementary to the contact portion 8. Further, the shaping segment 32 may be electrically contacted separately from the remainder of the shaping body 3 so as to be able to check contact of the contact pin 4 against the shaping segment 32. For this purpose, the shaping segment 32 may be electrically insulated from the rest of the shaping body 3.

The housing body 7 may be thermally treated so as to be able to fix the contact pins 4 thereto. For example, the housing body may be made plastically deformable by heating, at least in part. In this way, the contact pins 4 and a deformed part of the housing body 7 can enter permanent positive interconnection.

Figure 2:
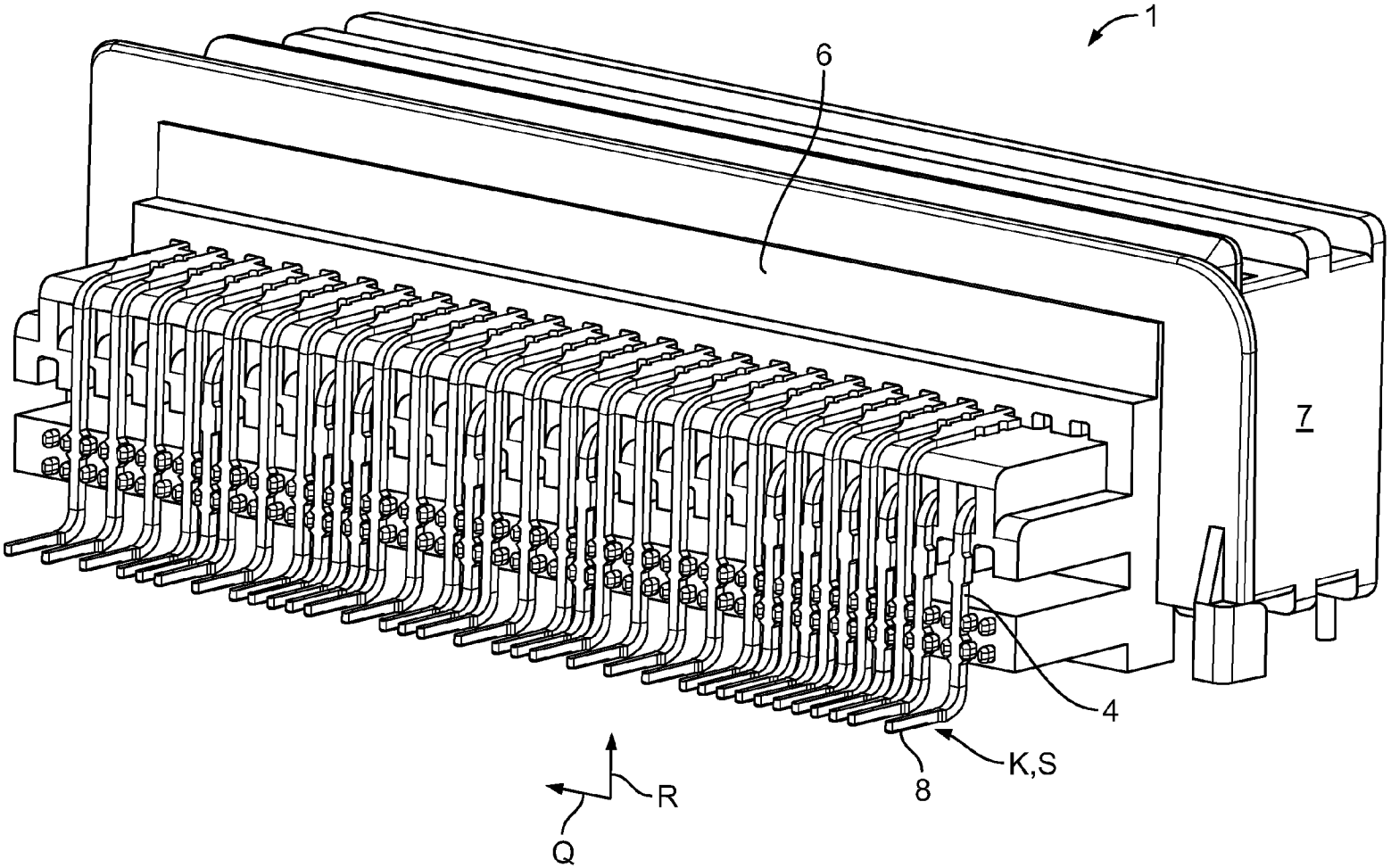
FIG. 2 shows the electric component having a plurality of preformed contact pins arranged along a contact contour.

FIG. 2 is a schematic perspective view of the electric component 1 of FIG. 1 with contact pins 4 orientated by the method according to the invention.

In the embodiment shown in this case, the contact portions 8 of all of the contact pins 4 are orientated to form the contact contour K. The contact contour K is defined by the contact portions 8 or the target positions S thereof. It corresponds to a plane, and the contact portions 5 of the orientated contact pins 4 are positioned in the target position S thereof in this common plane. The contact portions 8 are substantially mutually flush in a transverse direction Q of the electric component 1. In the pressing direction R extending perpendicular to the transverse direction Q, the orientation of the contact portions 8 deviates by a maximum of ±0.15 mm from the target positions S thereof.

Based on the orientation of the contact pins 4, this component 1 can be soldered without difficulty to a planar contact carrier, since all of the contact pins, and in particular the contact portions 8 thereof, are orientated in a well-defined position. Based on this well-defined position, all of the orientated contact portions 8 are positioned on a contact plane arranged in the surface of the contact support during fitting. Contact pins 4, which project from the contact support and potentially cannot be soldered to the contact carrier because of their distance therefrom, do not occur.

Figure 3:
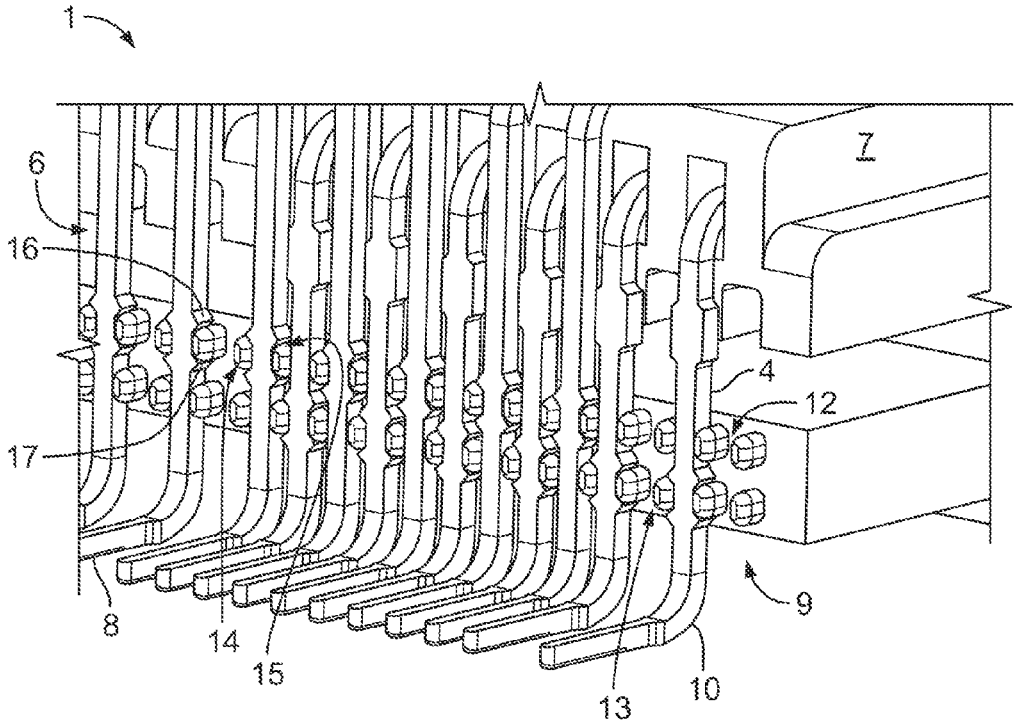
FIG. 3 is an enlarged view of the electric component.

FIG. 3 is an enlarged schematic perspective view of the electric component 1 of FIGS. 1 and 2.

The shown face 6 of the electric component 1 which may also be referred to as a rear face, opposes a contact face, which can be plugged into for example a counter plug, of the component, and may be provided with a fixing grid 9. By means of the fixing grid 9, the contact pins 4 can be secured against unintentional displacements parallel to the contact contour K, for example towards or away from one another, or even perpendicular to the contact contour K. For example, the fixing grid 9 may receive the contact pins 4 positively, at least in portions. So as to be able to orientate the contact pins 4, and in particular the contact portions 8 thereof, it may be necessary not only to deform the contact ends 8 plastically around a bend point 10, but also to displace them perpendicular to the contact contour K. Consequently, it may be advantageous for the fixing grid 9 initially to secure the position of the contact pins 4 with a particular tolerance, for example ±0.5 mm, and subsequently to fix the position of the orientated contact pins 4 permanently.

The fixing grid 9 may comprise a plurality of fixing knobs 11, which may project from the housing body 7. A fixing channel 12 for one of the contact pins 4 may extend at least between two fixing knobs 11. At least two pairs of fixing knobs 11 may be provided along the fixing channel 12, the fixing knobs 11 flanking the fixing channel 12 in pairs. A contact pin 4 arranged in the fixing channel 12 is secured against displacements, at least parallel to the contact contour K, and in particular along the transverse direction Q, by the fixing knobs 11.

The contact pins 4 may be formed complementary to the fixing grid 9, at least in portions. For example, the contact pins 4 may be formed with a biconvex fixing portion 13. The biconvex fixing portion 13 may be formed by two holding indentations 14, 15, which in the embodiment shown in this case may each be defined by two fixing projections 16, 17 along the respective contact pin 4. The substantially positive-fitting configuration of the fixing knobs 11 and the holding indentations 14, 15 mean that the contact pin 4 can also be secured against displacements perpendicular to the contact contour K, and in particular in and counter to the pressing direction R.

In the embodiment of FIG. 3, the contact pins 4 are arranged in the fixing grid 9 so as to be displaceable in and counter to the pressing direction R by the above-mentioned tolerance.

Figure 4:
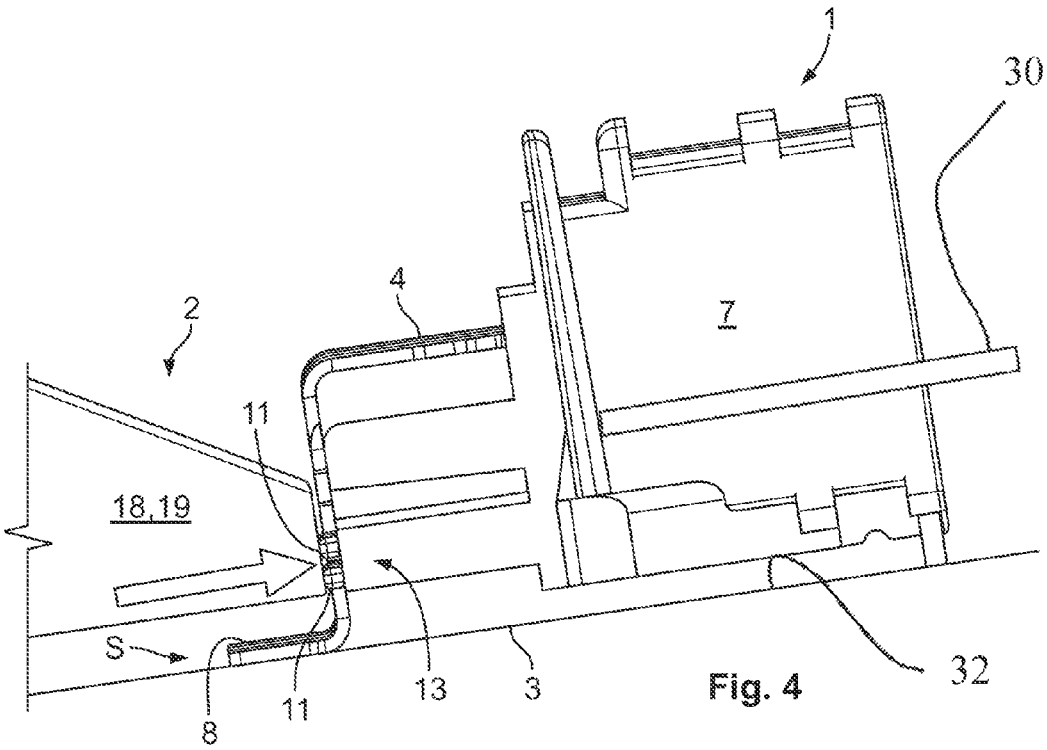
FIG. 4 shows the electric component together with a hot stamp.

FIG. 4 is a schematic side view of the electric component of FIGS. 1 to 3 in a further method step.

In the target position S thereof, the contact ends 8 of the contact pins 4 lie against the shaping body 3. To fix the position of the contact portions 8 relative to the housing body 7, at least some of the fixing knobs 11 are deformed in such a way that the holding indentations 14, 15 are substantially completely filled. Further, the deformed fixing knobs 11 may engage around the fixing portion 13 at least in part on the side thereof remote from the housing body 7. This results in the contact pins 4 being fixed substantially undisplaceably on the housing body 7.

For deforming the fixing knobs 11, the adjustment arrangement 2 may comprise a heating device 18, with which fixing knobs 11 manufactured from a thermoplastic material can be melted at least in part. The heating device may for example be a radiant heater or a heater fan. A hot stamp 19 is a preferred embodiment of the heating device 18. The hot stamp 19 can be brought into direct mechanical contact with the fixing knobs 11 to fix the contact pins 4. On the one hand, this makes heat transfer possible in a selective and effective manner. On the other hand, the heat stamp 19 can be pressed against the melting fixing knob 11 in such a way that the melted material is pressed into the biconvex fixing portions 13 of the contact pins 4. If the hot stamp 19 is removed from the shown operating position thereof, the fixing knobs 11 cool down. The fixing knobs 11 solidify and form a permanent positive connection at least with the fixing portions 13 of the contact pins 4. Once the fixing knobs 11 have rigidified sufficiently, the component 1 can be removed from the shaping body 3. The contact portions 8 remain in the target position S thereof.

Figure 5:
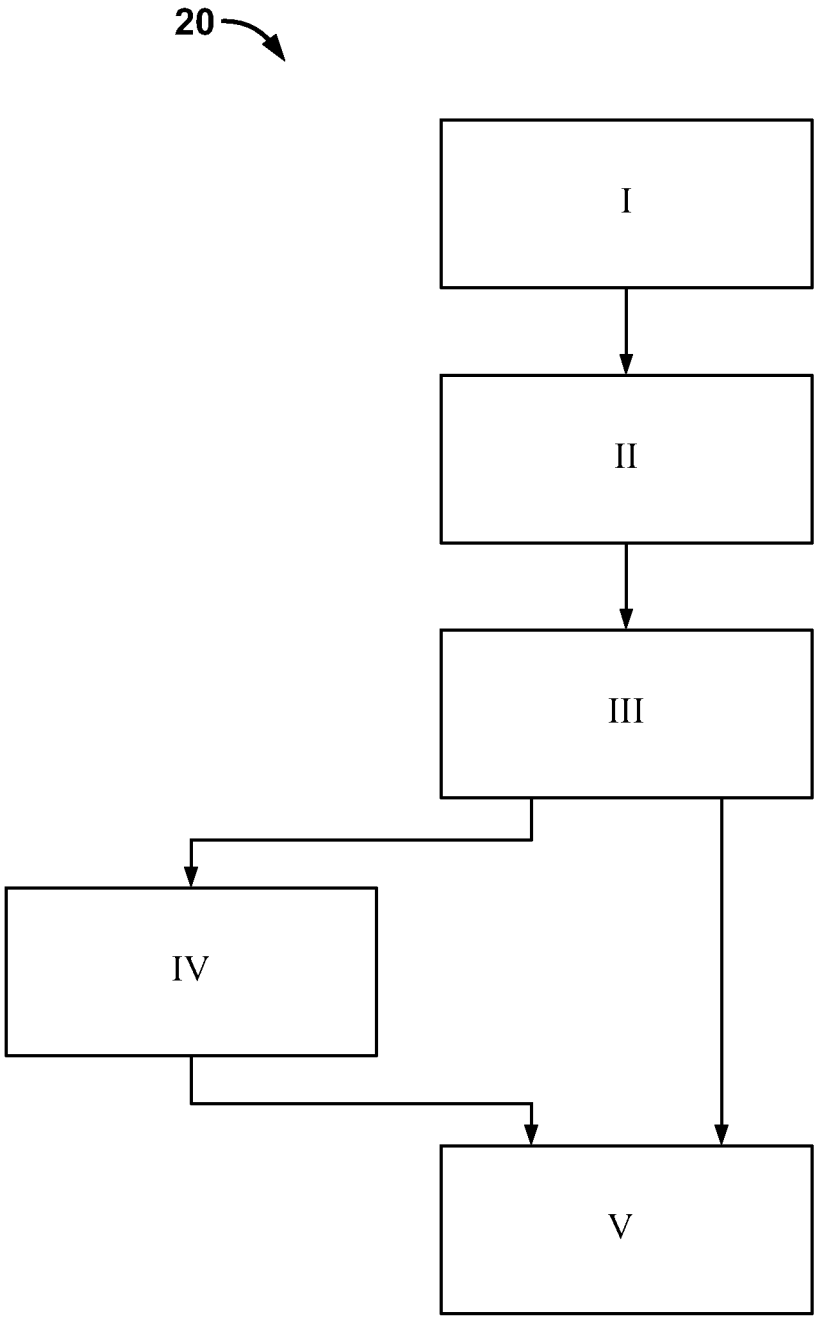
FIG. 5 shows an embodiment of a method for orientating contact pins, having a plurality of method steps.

FIG. 5 shows a first embodiment of the method 20 according to the invention for orientating contact pins 4 of an electric component 1. Like reference numerals are used for elements which correspond in operation and/or construction to the elements of the embodiment of FIGS. 1 and 2. For the sake of brevity, only the differences from the embodiment of FIGS. 1 and 2 will be discussed.

In a first method step I, which is known from the prior art, a plurality of contact pins 4 are mounted on the housing body 7 of the electric component 1. For example, the contact pins 4 are plugged into the housing body 7. The contact pins 4 are deformed prior or subsequent to being mounted. The contact pins 4 may for example be bent from an elongate shape into a Z-like or C-like shape. Alternatively, the contact pins 4 may be punched out.

However, in particular when the contact pins 4 are bent, tolerances may occur which can cause the position of the mounted contact pins 4 to vary greatly relative to the desired contact contour K, in such a way that the component is not adapted for subsequent processes. Further, the housing body 7 may also receive the individual contact pins 4 differently or cause variation in the mounting process, in such a way that even the position of contact pins 4 which are punched out identically may be subject to a tolerance. Even deviations of ±0.3 mm may be too large in some applications.

In a further method step II, the electric component 1 can be positioned in the adjustment arrangement 2. For example, the electric component 1 may be positioned and fixed precisely in the holding device. In particular, the housing body 7 of the electric component 1 may be positioned in the holding device and held in this defined position.

In the following method step III, the shaping body 3 can be moved relative to the component or to the holding device, towards the component 1, until said shaping body is arranged in the orientation position A. In this orientation position A, at least some of the approximately pre-positioned contact pins 4 are orientated to form the contact contour K at least in portions; for example, the contact portions 6 thereof are orientated along the contact contour K in the target position S.

Alternatively, the portions to be orientated of the contact pins 4 may also be deformed beyond the target position S. Potentially occurring resilient restoring forces can subsequently move the portions to be orientated of the contact pins 4 back into the target position S at the end of the method. Further, the contact pins 4 can be bent plastically back into the target position. The positioning of the shaping body 3 relative to the holding device may for example be monitored and controlled, for example by means of a location sensor or a force or current sensor. The orientation position A may also be provided by the stop member. The shaping member 3 and/or the holding device may be moved automatically or manually for orientation.

In an optional method step IV, the housing body 7 may be thermally treated, and in particular heated, at least in part. In this way, the housing body 7 can be plastically deformed in portions and enter a permanent positive connection with the contact pins 4. The thermal treatment may be carried out while the contact pins 4 are in contact against the shaping body 3.

In a further method step V, the electric component 1 and the shaping body 3 can be removed from one another. The contact pins 4 and for example the contact portions 6 thereof are orientated to form the contact contour K with a low variance of for example ±0.15 mm or less once the shaping body 3 is no longer in mechanical contact with the contact pins 4. The component 1 can be removed from the adjustment arrangement 2 and introduced to a subsequent process.

The invention claimed is:

1. Method for orientating contact pins of an electric component, in which a plurality of contact pins are preformed and arranged along a contact contour (K), wherein the arranged contact pins are subsequently orientated simultaneously by a shaping body to form the contact contour (K).

2. Method according to claim 1, wherein the contact pins are orientated simultaneously on one side of the component.

3. Method according to claim 1, wherein contact portions arranged at the free ends of the contact pins are orientated along the contact contour (K).

4. Method according to claim 1, wherein the contact pins are held for orientation along the contact contour (K), and at the same time, the component is thermally treated.

5. Method according to claim 1, wherein the position of the contact pins relative to a housing body of the component is fixed by thermal treatment.

6. Electric component comprising a plurality of contact pins, wherein at least some of the contact pins are orientated to form a contact contour (K) using a method according to claim 1.

7. Adjustment arrangement for orientating preformed contact pins of an electric component which are arranged to form a contact contour (K), comprising a holding device for fixing the component, wherein a shaping body with which a plurality of contact pins can be orientated simultaneously to form the contact contour (K).

8. Adjustment arrangement according to claim 7, wherein the holding device and the shaping body can be moved towards one another.

9. Electric component comprising a plurality of contact pins, wherein at least some of the contact pins are orientated to form a contact contour (K) using an adjustment arrangement according to claim 8.

10. Adjustment arrangement according claim 7, wherein the shaping body comprises an orientation side which is formed so as to correspond to the contact contour (K) at least in portions.

11. Adjustment arrangement according to claim 7, wherein the shaping body has a holding structure which is formed complementary to one of the contact pins, at least in portions.

12. Adjustment arrangement according to claim 11, wherein the shaping body has at least one shaping segment which can be electrically contacted separately from a remainder of the shaping body.

13. Adjustment arrangement according to claim 12, wherein the shaping segment is configured with the holding structure.

14. Adjustment arrangement according to claim 13, wherein a heating device comprising a hot stamp for heating the component.

15. Electric component comprising a plurality of contact pins and a housing body from which the contact pins project, wherein the contact pins are arranged with a deviation of at most ±0.15 mm from a contact contour (K).

16. Electric component according to claim 15, wherein the housing body has a fixing grid to which the contact pins are permanently positively connected.

17. Electric component according to claim 16, wherein the contact pins have at least one fixing portion, which is configured to be biconvex at least in portions, for connection to the fixing grid, the fixing portions of adjacent contact pins being arranged mutually offset.

* * * * *